United States Patent [19]

Swett, Jr.

[11] 4,355,809

[45] Oct. 26, 1982

[54] GOLF CLUB ALIGNER

[76] Inventor: H. Robert Swett, Jr., 7844 Kenskill Cir., Lantana, Fla. 33462

[21] Appl. No.: 180,974

[22] Filed: Aug. 25, 1980

[51] Int. Cl.[3] ..... A63B 69/36

[52] U.S. Cl. ..... 273/183 D; 273/186 C

[58] Field of Search ..... 273/191 R, 194 A, 187 A, 273/186 A, 183 D, 79, 186 R, 186 C, 192, 183 E

[56] References Cited

U.S. PATENT DOCUMENTS

| | | | |
|---|---|---|---|
| 1,536,512 | 5/1925 | McLaren | 273/192 X |
| 2,003,951 | 6/1935 | Pepin | 273/164 |
| 2,869,875 | 1/1959 | Steenson | 273/191 R X |
| 3,325,168 | 6/1967 | Fyanes | 273/194 A X |
| 3,667,761 | 6/1972 | Palotsee | 273/186 A |
| 4,000,905 | 1/1977 | Shirhall | 273/187 A |

FOREIGN PATENT DOCUMENTS

| | | | |
|---|---|---|---|
| 1295471 | 11/1972 | United Kingdom | 273/186 R |

*Primary Examiner*—George J. Marlo
*Attorney, Agent, or Firm*—David F. Gould

[57] ABSTRACT

A training device to improve the use of golf club irons by indicating whether the golfer tends to align his irons to hit a golf ball to the left or right of the true course. A slidable ball holder with golf club placement indicia is addressed with the golf iron. A vertical reference pole is mounted at one end of the slidable ball holder. A detachable long rigid slender pointer is attached as with a magnet to the striking face of the golf iron. The pointer indicates if the striking face of the golf iron is aligned to hit a ball to the left or right of the vertical reference pole.

4 Claims, 3 Drawing Figures

| | |
|---|---|
| #1-18° | #6-35° |
| #2-20° | #7-39° |
| #3-23° | #8-43° |
| #4-27° | #9-47° |
| #5-31° | P.W.-51° |
| | S.W.-57° |

GOLF CLUB ALIGNER

BACKGROUND

1. Field of the Invention

My invention relates to the field of golf training aids. In particular, my invention is in the field of golf club aligners whereby a golfer is able to check how he aligns his irons with a golf ball. The principle of the invention is to have the golfer assume the proper stance and align his iron with a simulated golf ball. The golfer lines up a vertical flag pole with a distant object and addresses the ball as if to hit it to the distant object. An indicator in the form of a long rigid slender pointer is then temporarily attached to the face of the iron in such a manner that the indicator is at right angles to the face of the iron. The indicator than shows whether the face of the iron is lined up with the distant object as indicated by the vertical flag pole or whether the iron is lined up to the left or right of the distant object as indicated by the vertical flag pole.

2. The Prior Art

Training aids for golf have been used for many years. They have been in general limited to devices which are designed to improve putting or the golf swing itself. The object of this training aid is to teach a golfer how to align his iron with the ball so that the iron will send the ball straight to a distant target and will not pull the ball to the left of the target or push the ball to the right of the target.

SUMMARY OF THE INVENTION

My invention is a solution to the problem of how to teach golfers to hold their irons so that the iron is aligned to hit the ball straight. A base plate or club indicator is provided for use on the grass outdoors or on a floor indoors. The base plate also serves as a ball holder. On one end of the base plate is positioned a small flag pole. The flag pole is mounted in a vertical position at right angles to the base plate. Stablizing rods may be provided to prevent the flag pole from tipping over. A simulated golf ball is slidably mounted on the base plate is such a manner that the ball may be moved horizontally to the desired position on the base plate. A long rigid slender pointer is provided for temporary attachment to the striking face of the iron when the iron is placed on the base plate. The attachment for the pointer to the iron may be a permanent magnet or some other easily removeable attachment.

DESCRIPTION OF PREFERRED EMBODIMENT

Figures 1, 3:
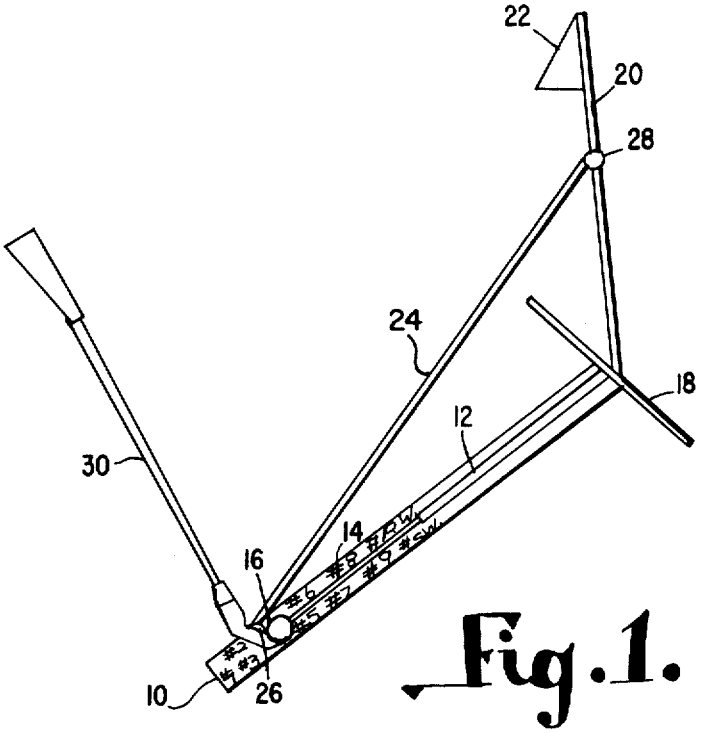
FIG. 1 is a perspective view of my invention with the pointer temporarily attached to the striking face of a golf iron.
FIG. 3 is a chart showing angles of loft for various golf irons.

As shown in FIG. 1 a base plate or ball holder 10 is provided for use as a golf club indicator. The base plate 10 may be made of aluminum strapping or other material such as a plastic. Indicia in the form of circles with letters and numbers are provided on the base plate 10. The numbered and lettered circles on the surface of the base plate 10 correspond to the position required for various golf club irons as will be later detailed with reference to FIG. 2 and FIG. 3. Slidably mounted on the base plate 10 is a simulated golf ball 16. A stationary tube 12 is provided mounted on a portion of the base plate 10. I provide a rod 14 which is slidably positioned with one end in the stationary tube 12 and the other end attached to the simulated golf ball 16. The simulated golf ball 16 may then be positioned at the desired location on the base plate 10 and is restrained from moving by the inertia of the slidable rod 14 which acts as a ball holder. A vertical reference or flag pole 20 is provided at the end of the base plate 10 remote from the simulated golf ball 16. The flag pole 20 is mounted in a vertical position at right angles to the base plate 10. A stabilizer rod 18 may be provided to keep the flag pole 20 rigid. A flag 22 may be attached to the flag pole 20 to aid in lining up the flag pole 20 with a distant object. The flag pole 20 and the stabilizer rod 18 may be made demountable so that the golf shot aligner may be disassembled for compact storage or shipment. A long rigid slender pointer 24 is provided for temporary attachment to the striking face of a golf iron 30. A permanent magnet 26 mounted on one end of the pointer 24 is convenient for such temporary attachment. An indicator ball 28 may be placed on the other end of the pointer 24 to make the pointer 24 show up more clearly.

Figure 2:
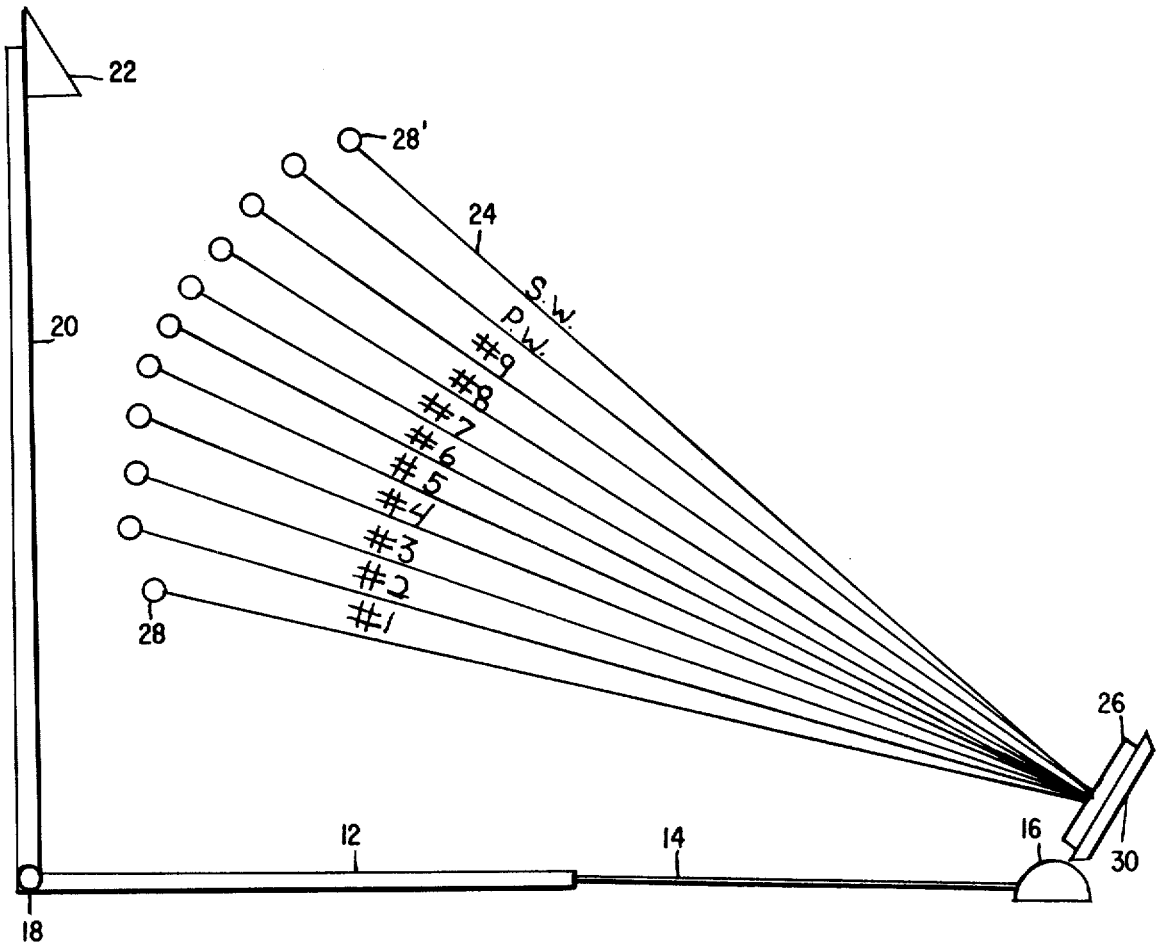
FIG. 2 is a side view of the invention with a diagram of the angles of loft of different golf irons.

Referring now to FIG. 2 and FIG. 3 where like numerals refer to like parts, a side view of the invention is shown along with a chart illustrating the angles of loft of various golf irons. The angle of loft is the angle that the face of golf iron lifts the ball from the horizontal when the ball is struck. It will be observed from the chart of FIG. 3 that the two extremes of loft are between 18 degrees for the #1 iron and 57 degrees for the sand wedge (s.w.). The second most highest angle of loft is achieved by the pitching wedge (p.w.) which has an angle of 51° measured from the horizontal. One can see that the indicator ball 28 associated with the #1 iron comes quite close to the vertical reference or flag pole 20. However, the indicator ball 28' associated with sand wedge (s.w.) is very far from the flag pole 20 if the ball 16 is left in the position used for the number one iron when the sand wedge (s.w.) is used. Hence, to get the indicator ball 28' close to the flag pole 20 when the golfer is checking the alignment of his sand wedge (s.w.) the simulated golf ball 16 is moved much closer to the flag pole 20 by pushing the slidable rod 14 into the stationary tube 12. This is best illustrated in the view of the base plate 10 or club indicator in FIG. 1. It is seen there that number 1 iron position is close to the end of the base plate 10 remote from the flag pole 20. The sand wedge (s.w.) position is very close to the stationary tube 12. Iron positions intermediate these two extremes are calibrated and marked on the base plate 10 or ball holder so that the indicator ball 28 is always close to the flag pole 20, regardless which iron the golfer is attempting to align. For example, the position for the six iron is approximately half way between the position of the number one iron and sand wedge (s.w.).

OPERATION

In operation, the golf club aligner is placed on a level floor or ground surface. The golder lines the vertical reference or flag pole 20 up with a distant object (not shown). The simulated golf ball 16 is moved to the position indicated by the indicia on the base plate or ball holder 10 corresponding to the golf club being used. The golfer assumes the proper stance as if to hit the simulated golf ball 16 at the distant object (not shown). The striking face of the golf iron 30 is aligned with the simulated ball 16 to the best of the golfer's ability. The golfer has a second person place the permanent magnet 26 of the pointer 24 on the striking face of the golf iron 30. The indicator ball 28 at the tip of the free end of pointer 24 is than observed. If the indicator ball 28 is to the right of the vertical reference or flag pole 20 the proposed iron shot will be pushed to the left. The golfer can then have the pointer 24 removed from the striking face of the golf iron 30 and complete the aligning and pointing process as often as necessary to have perfect alignment of the striking face of the golf iron 30 with the simulated golf ball 16. With practice, the golfer can align any golf iron 30 with his proposed target so that the indicator ball 28 on the free end of pointer 24 is pointing directly at the flag pole 20.

The foregoing is considered at illustrative only of the principles of the invention. Furthermore, since numerous modifications and changes will readily occur to those skilled in the art, it is not desired to limit the invention to the exact construction and operation shown and described and accordingly all suitable modification and equivalents may be resorted to falling within the scoop of the invention as claimed:

I claim as my invention:

1. A golf club aligner comprising in combination, a base plate, a slidable horizontal ball holder mounted on the base plate, a vertical reference pole located near one end of the base plate, a long rigid slender pointer including means for temporarily attaching one end thereof to the striking face of a golf club so that the other end of the pointer extends towards the vertical reference pole, golf club placement indicia on the base plate spaced to keep one end of the pointer when attached to a golf club being aligned in proximity to the vertical reference pole by compensating for the various angles of loft of different golf clubs.

2. The golf club aligner of claim 1 in which the means for temporarily attaching the pointer to the striking face of a golf club is a permanent magnet mounted on one end of the pointer.

3. The golf club aligner of claim 1 in which the golf club placement indicia is placed on the base plate so spaced that the indicia for golf clubs having increasing angles of loft are progressively closer to the vertical reference pole to keep one end of the pointer when attached to a golf club being aligned in proximity to the vertical reference pole thereby compensating for the various angles of loft of different golf clubs.

4. The golf club aligner of claim 1 in which a golf ball is mounted on the slidable horizontal ball holder to provide a place to address the striking face of a golf club before attaching the pointer.

* * * * *